US006169557B1

(12) United States Patent
Suzuki et al.

(10) Patent No.: US 6,169,557 B1
(45) **Date of Patent: *Jan. 2, 2001**

(54) RECORDING APPARATUS

(75) Inventors: Tetsuo Suzuki, Kawasaki; Tamaki Hashimoto, Yokohama; Takao Aichi, Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/779,030

(22) Filed: Jan. 6, 1997

Related U.S. Application Data

(62) Division of application No. 08/606,683, filed on Feb. 26, 1996, now Pat. No. 5,710,587, which is a continuation of application No. 08/348,078, filed on Nov. 23, 1994, now abandoned, which is a continuation of application No. 07/915,748, filed on Jul. 21, 1992, now abandoned, which is a continuation of application No. 07/417,051, filed on Oct. 4, 1989, now abandoned.

(30) Foreign Application Priority Data

Oct. 7, 1988 (JP) ..... 63-254213

(51) Int. Cl.[7] ..... B41J 2/01

(52) U.S. Cl. ..... 347/104; 271/110; 400/314.6; 400/550

(58) Field of Search ..... 347/104; 400/283, 400/313, 314, 314.6, 545, 550, 569; 271/110, 111

(56) References Cited

U.S. PATENT DOCUMENTS

| | | | | |
|---|---|---|---|---|
| 3,970,384 | | 7/1976 | Yamamoto et al. | 399/21 |
| 4,565,461 | | 1/1986 | Usui et al. | 400/611 |
| 4,692,778 | | 9/1987 | Yoshimura et al. | 346/145 |
| 4,772,898 | | 9/1988 | Noda | 346/136 |
| 4,871,160 | * | 10/1989 | Yoshino | 271/110 |
| 4,884,085 | | 11/1989 | Ozawa et al. | 346/136 |
| 4,894,668 | | 1/1990 | Ozawa et al. | 346/136 |
| 5,138,343 | | 8/1992 | Aichi et al. | 346/30 |

FOREIGN PATENT DOCUMENTS

| | | | |
|---|---|---|---|
| 56-33245 | | 4/1981 | (JP) . |
| 63-130440 | * | 8/1988 | (JP) . |
| 63-212571 | * | 9/1988 | (JP) . |
| 1-184174 | | 7/1989 | (JP) . |

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

A recording apparatus for performing a recording operation on recording paper includes a recording head for performing the recording operation on the recording paper, a carriage which carries the recording head, and is movable along a convey path of the recording paper, a conveying unit for conveying the recording paper, a drive source, and a lock pawl which is arranged along a moving path of the carriage and can transmit a drive force from the drive source to the conveying unit in accordance with movement of the carriage.

2 Claims, 8 Drawing Sheets

| FIG. 4A |
| --- |
| FIG. 4B |

RECORDING APPARATUS

This application is a division of application Ser. No. 08/606,683, filed Feb. 26, 1996, now U.S. Pat. No. 5,710, 589, which is a continuation of application Ser. No. 08/348, 078, filed Nov. 23, 1994, now abandoned, which is a continuation of application Ser. No. 07/915,748, filed Jul. 21, 1992, now abandoned, which is a continuation of application Ser. No. 07/417,051, filed Oct. 4, 1989, now abandoned.

BACKGROUND OF THE INVENTION

1. Field of the Invention

The present invention relates to a recording apparatus for performing a recording operation on a recording medium using a recording means and, more particularly, to a recording apparatus having a function of feeding the recording medium.

2. Description of the Related Art

A paper feed operation in a recording apparatus of this type is realized by energizing/deenergizing a spring clutch of a drive power transmission unit by a power source such as a plunger.

In order to perform the paper feed operation, the power source such as a plunger must be arranged, and an apparatus size tends to be increased. In addition, timing control of the power source is also necessary, and a control section of the apparatus tends to be complicated.

In order to eliminate the above drawbacks, a system has been presented for starting a paper feed operation by energizing a spring clutch upon operation of a carriage while omitting a plunger for the purpose of a decrease in cost and the like in an apparatus having a carriage which carries a recording head, as in (Japanese Patent Application No. 63-9274 filed on Jan. 19, 1988).

In this system, a lock ring of the spring clutch arranged outside a recording region defined by the movement of the carriage is locked or released (rotatable) by a lock pawl so as to cooperate a separation roller and a pressing plate mounting recording paper, thus ON/OFF-controlling a paper feed operation. More specifically, a portion of the carriage is brought into dynamic contact with the lock pawl to release engagement of the lock ring by the lock pawl, thus setting the lock ring to be rotatable. When the lock ring is set to be rotatable, the spring clutch can transmit a rotational force, and the paper feed operation is started.

In this system, the lock pawl is located at a position (to be referred to as a paper feed position hereinafter) opposite to the home position of the carriage outside the recording region to prevent that the carriage accidentally releases engagement of the lock pawl every time it is moved to perform a recording operation. Therefore, when the lock pawl is released, the carriage is moved from the home position to the paper feed position.

A distance between the recording region and the paper feed position is minimized to reduce a moving range of the carriage as much as possible and to make the apparatus compact.

SUMMARY OF THE INVENTION

It is an object of the present invention to provide a compact recording apparatus.

It is another object of the present invention to provide a recording apparatus which can reliably feed a recording medium.

It is still another object of the present invention to provide a recording apparatus which can precisely determine a feed timing of a recording medium.

It is still another object of the present invention to provide a recording apparatus which can reduce cost.

It is still another object of the present invention to provide a recording apparatus which can eliminate a lock-pawl release error by performing a clock release operation by a carriage a plurality of times, and can reliably feed thick recording paper.

DETAILED DESCRIPTION OF THE PREFERRED EMBODIMENT

An embodiment of the present invention will now be described with reference to the accompanying drawings.

Figure 1:
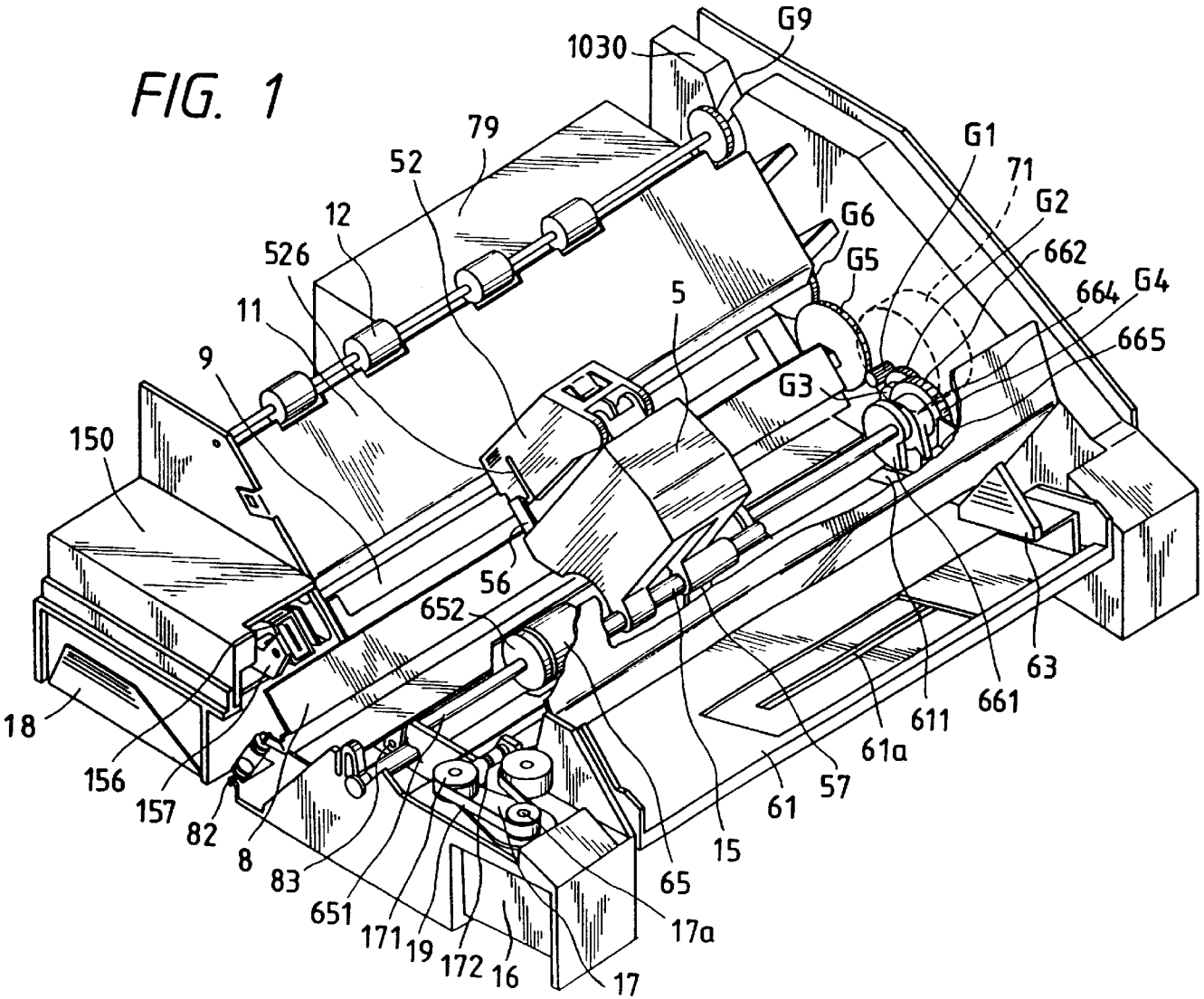
FIG. 1 is a perspective view of the outer appearance of an ink-jet recording apparatus according to an embodiment of the present invention.
Figure 2:
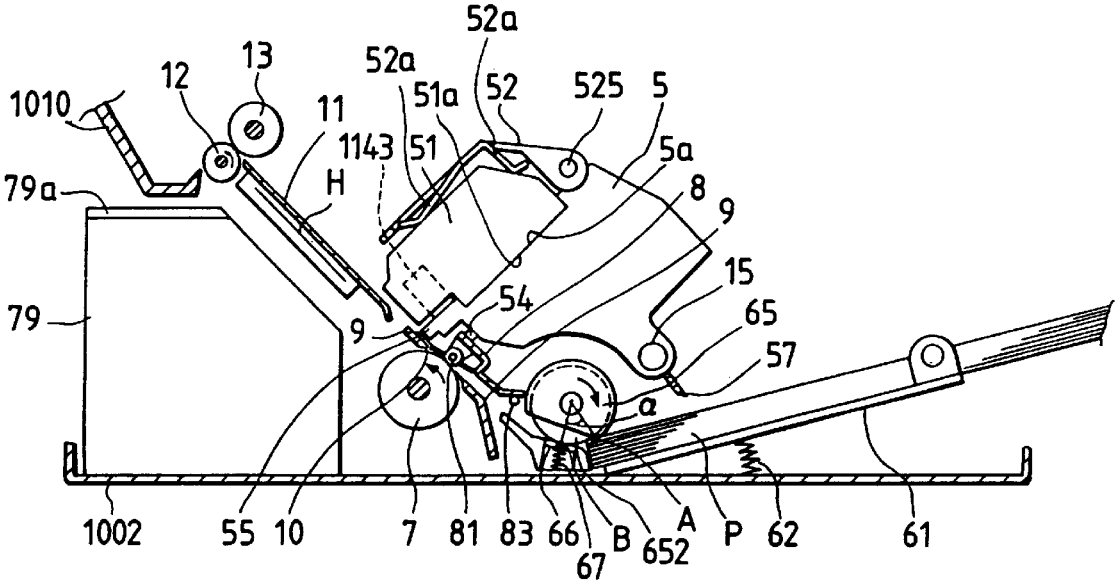
FIG. 2 is a sectional view of a principal portion of the apparatus shown in FIG. 1.
Figure 3:
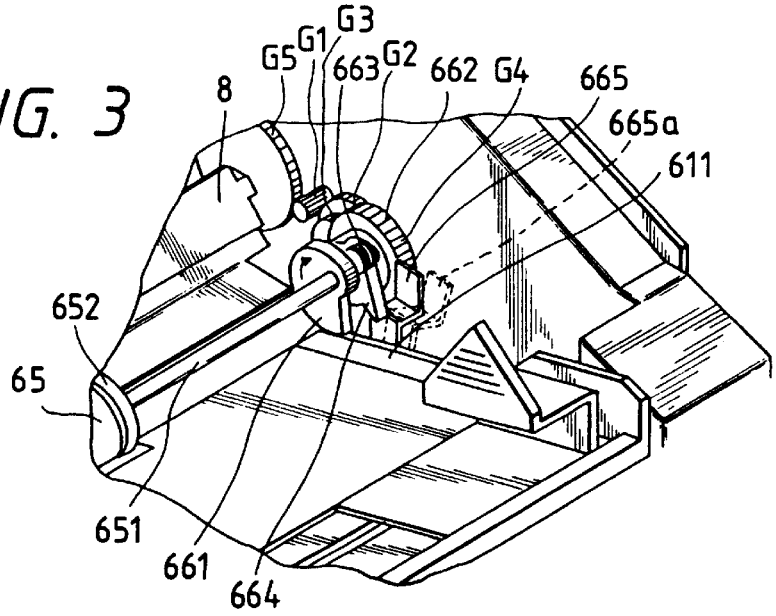
FIG. 3 is an enlarged perspective view of a paper feed mechanism portion shown in FIG. 1.

FIG. 1 is a perspective view of the outer appearance of an ink-jet recording apparatus according to the embodiment of the present invention, and FIG. 2 is a sectional view of the principal portion of the apparatus shown in FIG. 1. FIG. 3 is a partial enlarged view of a paper feed mechanism portion of FIG. 1.

In FIGS. 1 to 3, a pressing plate 61 stacks sheets of recording paper thereon to feed them to the ink-jet recording apparatus. A pressing plate spring 62 is attached to a lower surface portion of the pressing plate 61. The pressing plate 61 is biased upward by the pressing plate spring 62. A paper width regulating plate 63 is arranged on the pressing plate 61 to be slidable along a groove 61*a*. The plate 63 is moved in accordance with the width of the recording paper sheets stacked on the pressing plate 61 to regulate the stacking position of the recording paper sheets. Separation rollers 65 are mounted above the pressing plate 61 to separate the recording paper sheets one by one, and are fixed on a separation roller shaft 651. Circular pressing rollers 652 are arranged at outer sides of the separation rollers 65, and are rotatably mounted on the separation roller shaft 651. A pressing plate push-down cam 661 is fixed to one end portion of the separation roller shaft 651, and a separation roller gear 662 is loosely fitted thereon adjacent to the cam 661. A spring clutch 663 is disposed between the pressing plate push-down cam 661 and the separation roller gear 662. When a lock ring 664 arranged around the spring clutch 663 is locked by a lock pawl 665, the spring clutch 663 is set in a rotational force non-transmission (OFF) state. When the lock pawl 665 is disengaged from the lock ring 664 and the lock ring 664 is set in a free state, the spring clutch 663 is set in a rotational force transmission (ON) state. The lock pawl 665 is located at a position where engagement between the lock pawl 665 and the lock ring 664 is released by a dynamic contact between the lock pawl 665 and a projecting portion 55 (FIG. 2) of a carriage 5.

A cam receiving portion 611 is formed in the pressing plate 61 at a position where it is engaged with the pressing plate push-down cam 661. The cam receiving portion 611 is formed to be perpendicular to the side edge portion of the pressing plate 61. When the cam receiving portion 611 is pushed downward by the pressing plate push-down cam 661 and, hence, the pressing plate 61 is pushed downward, the recording paper sheets stacked on the pressing plate 61 are separated from the separation rollers 65 and the pressing rollers 652. When the push-down cam 661 releases engagement with the cam receiving portion 611, the pressing plate 61 is pushed upward by the pressing plate spring 62, and the recording paper sheets are urged against the separation rollers 65.

A separation pad 66 for frictionally separating the recording paper sheets one by one is arranged at the downstream side in a paper feed direction of the pressing plate 61. The separation pad 66 is biased toward the separation rollers 65 and the pressing rollers 652 by a pad spring 67. The pressing roller 652 has a circular section perpendicular to the roller shaft 651. The separation roller 65 has a semi-circular arcuated section perpendicular to the roller shaft 651. The radius of the separation roller 65 is set to be slightly larger than that of the pressing roller 652 (e.g., about 0.5 to 5 mm). As a result, the separation pad 66 is urged against the separation rollers 65 within their arcuated range, and is urged against the pressing rollers 652 in the other range.

The separation roller 65 has a relatively small diameter, i.e., about 20 to 30 mm. Thus, an angle a defined by a contact point A between the pressing plate 61 and the separation rollers 65 and a contact point B between the separation pad 66 and the separation rollers 65 can be set to be large, as shown in FIG. 2. Therefore, an entrance angle of the leading end of a recording paper picked up by the separation rollers 65 can become large relative to the pressing plate 61. A plurality of recording paper sheets are satisfactorily rubbed here, and hence, separation performance will not be impaired even if the separation pad pressure by the pad spring 67 is small. A conventional separation roller (diameter: about 40 mm) requires a separation pad pressure of about 300 g, while a small-diameter (20–30 mm) separation roller requires only about 50 g to assure separation performance. Therefore, when a recording paper is fed by a paper feed roller 7, a back tension received at the roller 7 from the pressing rollers 652 and the separation pad 66 can be reduced, and a stable paper feed operation can be guaranteed.

Since the separation pad pressure by the pad spring 67 is small, a change in feed amount caused when the trailing end of recording paper is disengaged from the separation pad 66 can be minimized.

The paper feed roller 7 is arranged along a convey path for conveying recording paper fed by the paper feed mechanism described above to a recording position opposing a recording head. A pinch roller 81 is arranged to oppose the paper feed roller 7 to sandwich recording paper therebetween. The pinch roller 81 is pivotally and axially supported on a pinch roller stay 8 two ends of which are biased by pinch roller springs 82. The pinch roller stay 8 is pivotally arranged about a stay pivot 93. A paper guide 9 guides recording paper fed by the paper feed mechanism to a position where the paper is sandwiched between the paper feed roller 7 and the pinch roller 81. A paper pressing plate 10 is formed of an elastic member. The paper pressing plate 10 is arranged to extend from the pinch roller stay 8 to the paper guide 9, and its leading end elastically presses the recording paper fed from the pinch roller 81 against the paper guide 9 therealong.

Figures 4, 4A:
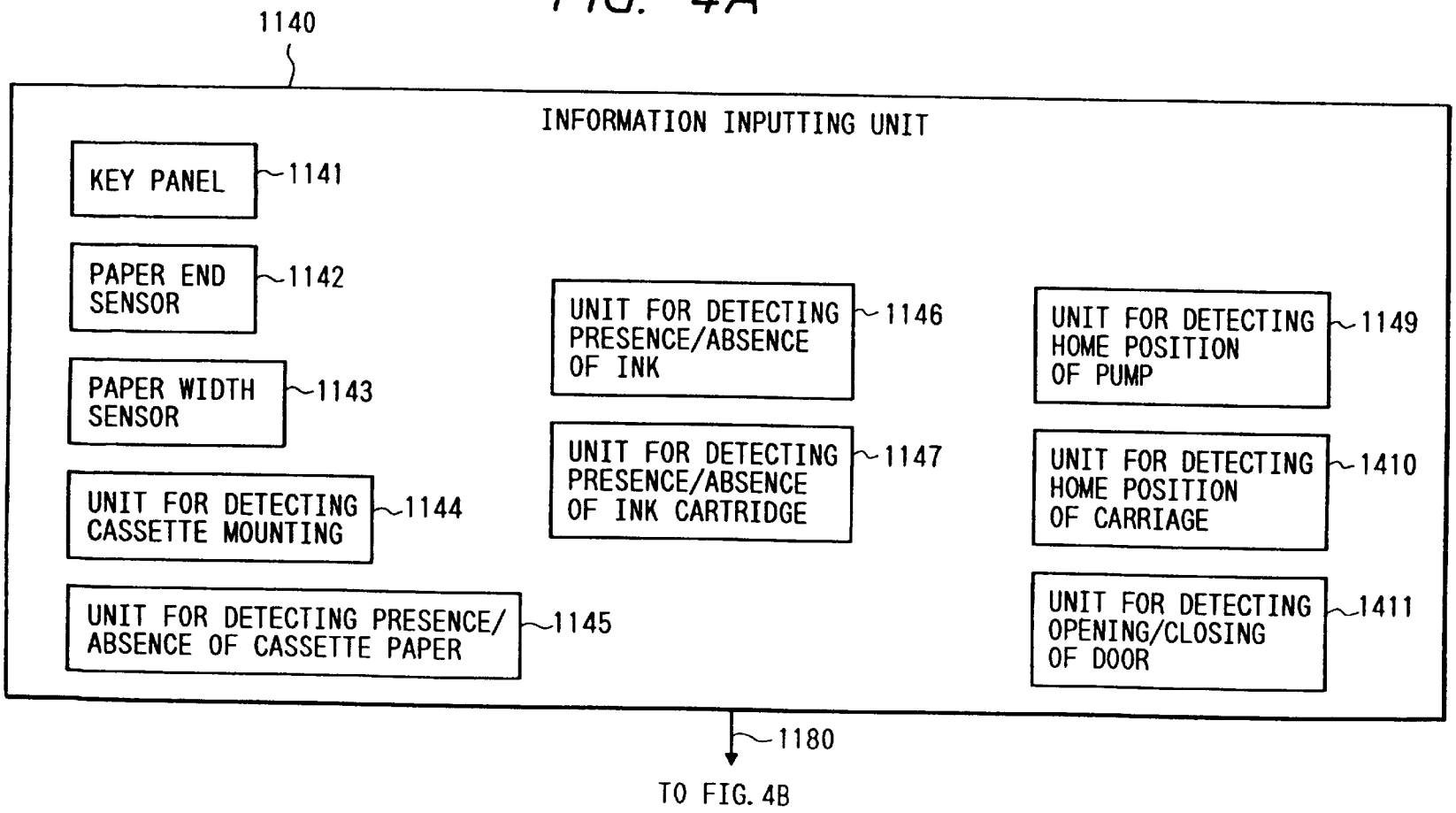
FIG. 4, which is comprised of FIGS. 4A and 4B is a block diagram showing a control arrangement of the ink-jet recording apparatus shown in FIGS. 1 to 3.

The paper feed roller 7 is driven by a motor 71 (FIGS. 1 and 4). In this case, a drive force is transmitted by gears by one stage, so that recording paper is fed by one recording line per revolution of the motor. Thus, eccentric components of the motor itself and motor gears causing image degradation, e.g., a white stripe, overlapping, and the like occurring at a junction portion of recording lines in a recorded image during a paper feed operation can be canceled. Only one stage of speed reduction gears is arranged between the drive motor 71 and the paper feed roller 7, and a drive force is transmitted by minimum transmission components. Therefore, an unnecessary error component is not included in the drive force.

In this embodiment, the paper feed roller 7, an exhaust roller 12, and the separation rollers 65 are driven by the drive force of the motor 71. More specifically, the drive force of the motor 71 rotates the separation rollers 65 through gears G1, G2, G3, and G4. On the other hand, the drive force of the motor 71 rotates the paper feed roller 7 and the exhaust roller 12 through gears G1, G5, G6, . . . , G9.

A heat plate 11 having a heater H on its lower surface is arranged at the downstream side of the roller 7 with respect to the convey direction of recording paper. The heat plate 11 accelerates fixing of an ink attached to recording paper during a recording operation together with heat from a power supply unit (to be described later). The temperature of the heat plate 11 falls within the range of 40° C. to 90° C. in a practical application. Exhaust pinch rollers 13 are arranged to oppose the exhaust roller 12. Each exhaust pinch roller 13 has a spur shape, and presses a recording surface side of the recording paper at points. Therefore, when a recording surface on which an ink is incompletely fixed passes between the rollers 12 and 13, it can be prevented from being contaminated due to rubbing. A feed speed of the exhaust roller 12 is few percents higher than that of the paper feed roller 7 to provide a tension to the recording paper, thus keeping tight-contact property and flatness of the recording paper at a recording position.

The heat plate 11 is located at the downstream side of the recording paper convey path with respect to a recording element of a recording head 51, so that heat produced by the heat plate 11 does not directly influence the recording element portion of the recording head 51. A gap is formed between the paper guide 9 and the heat plate 11, and detection by a paper width sensor 1143 comprising a reflection type photosensor arranged on the carriage 5 is performed at the gap portion, thus preventing a detection error caused by reflection by the guide, or the like.

The carriage 5 is engaged with a guide shaft 15 to be movable in a right-and-left direction. A drive force of a motor 16 is transmitted to the carriage 5 through a belt 19. A pulley 171 is arranged on a tension plate 17 which has a shaft 17*a* as a pivot, which is coaxial with the motor 16, so that a given tension is given to the belt 19 by a tension spring 172.

The carriage 5 is mounted to be pivotal about the guide shaft 15. An urging portion 54 of the carriage 5 urges the surface of the pinch roller stay 8 by the weight of the carriage 5 (FIG. 2). The urging portion 54 serves as a slider, and slides on the pinch roller stay 8 upon movement of the carriage 5. The urging portion 54 is formed of a resin having an especially high slidability such as Teflon. The carriage 5 has the projecting portion 55 near a portion connected to the recording head 51. The projecting portion 55 projects forward (toward the roller 7) from the ejection surface of the recording head 51 by about 0.3 to 0.5 mm. In a normal state (for a thin recording paper), however, the projecting portion 55 is not brought into contact with the paper pressing plate 10.

The recording head 51 has orifices, arrayed in the paper feed direction, for injecting an ink liquid, and injection energy generating elements corresponding to the orifices. When a projection 51*a* of the recording head 51 is fitted in an opening 5*a* of the carriage 5, the position of the recording head 51 with respect to the carriage 5 is determined. A fixing lever 52 is arranged on the carriage 5 to be pivotal about a pivot 525. The fixing lever 52 has an elastic portion 52*a* for producing a pressing force when the recording head 51 is fixed to the carriage 5. When a fixing lever hook portion 52*b* of the lever 52 is engaged with a hook portion 5*b* of the carriage 5, the fixing lever 52 is locked, thus fixing the recording head 51 to the carriage 5.

The carriage 5 is provided with the paper width sensor 1143 for detecting the width of recording paper and the presence/absence of the recording paper when the carriage 5 is moved. The paper width sensor 1143 is mounted so that its detection position is located near the ejection orifice located at the most downstream side in the paper feed direction of the recording head 51. Furthermore, a projecting portion 57 for releasing engagement of the lock pawl 665 of the paper feed mechanism described above is provided near a portion where the carriage 5 is engaged with the guide shaft 15. The projecting portion 57 is brought into contact with the lock pawl 665 at a predetermined position outside a recording region on a carriage moving path, thereby releasing engagement. The carriage 5 has a cap positioning pin. The cap positioning pin is used such that the carriage 5 is escaped to a position of a recovery device to cap the recording element surface of the recording head 51 in a non-recording mode.

An operation for releasing engagement of the lock pawl 665 will be described in more detail below. The projecting portion 57 pushes the lock pawl 665 outwardly to release engagement between the lock pawl 665 and the lock ring 664 (a dotted portion 665*a* in FIG. 3). When the lock pawl 665 and the lock ring 664 are disengaged from each other, the spring clutch 663 is ON, and the pressing plate push-down cam 661 is rotated clockwise as indicated by an arrow in FIGS. 1 and 3 by the drive force of the motor 71. Thus, the pressing plate push-down cam 661 is disengaged from the cam receiving portion 611, and the pressing plate 61 is pushed upward by the biasing force of the spring 62. Thus, recording paper sheets stacked on the pressing plate 61 are brought into contact with the separation rollers 65. Thereafter, the carriage 5 is immediately moved backward, and the lock pawl 665 is also returned (from a state indicated by a dotted line 665*a* to a state indicated by a solid line). When the lock ring 664 has been rotated once, it is engaged with the returned lock pawl 665, thus setting a lock state.

An ejection recovery device 150 performs capping and ink suction of the ejection surface of the recording head 51, and is arranged at one side of the moving path of the carriage 5 outside the recording region. The ejection recovery device 150 includes a cap 156 for capping the ejection surface of the recording head 51. The cap 156 comprises a positioning lever 157 which is engaged with the positioning pin of the carriage 5. An ink cartridge 18 stores an ink to be supplied to the recording head 51. The ink cartridge 18 comprises an ink recovery portion for storing ink drawn by capping.

The power source unit 79 described above is fixed to a bottom plate 1002 so that its heat radiation plate 79*a* is located immediately below an exhaust tray 1010. Even if recording paper is in a non-dried state, drying is promoted in the exhaust tray 1010.

The operation of the above-mentioned structure will be described below.

In a non-recording mode, the carriage 5 is capped by the cap 156 of the recovery device 150, and is in a recording standby state. Upon reception of recording data from a host computer or data transferring device 1100 (FIG. 4), the carriage 5 starts moving to disengage the lock pawl 665 located at a position opposite to the recovery device 150 on the moving path. As described above, the projecting portion 57 pushes the lock pawl 665 outwardly to disengage the lock pawl 665. The lock ring 664 is then set in a free state, and rotation of the separation roller gear 662 can be transmitted to the separation rollers 65 and the pressing plate push-down cam 661. The separation rollers 65 and the pressing plate push-down cam 661 start rotation upon operation of the motor 71. After the motor 71 starts its operation, the carriage 5 is moved to a position where it does not interfere with a return movement of the lock pawl 665 to its return position by the own elastic force (position where the lock pawl is engaged with the lock ring 664), and is set in the standby state. When the pressing plate push-down cam 661 begins to rotate, the pressing plate 61 is moved upward by the biasing force of the pressing plate spring 62, and is urged against the separation rollers 65. Upon rotation of the separation rollers 65, recording paper is fed to the position of the separation pad 66. A plurality of recording paper sheets are rubbed by the separation rollers 65 and the separation pad 66, and only one recording paper sheet is fed to the position of the paper feed roller 7 and the pinch roller 81 within one revolution of the separation rollers 65. When the pawl of the lock ring 664 reaches the position of the lock pawl 665, the rotation of the lock ring 665 is inhibited, thus stopping rotation of the separation rollers 65.

Normally, the paper feed operation is completed within one revolution of the separation rollers 65. When a distance to the paper feed roller 7 is set to be longer than a peripheral length of the separation roller 65 in favor of the arrangement of the apparatus, the separation rollers 65 are rotated a plurality of times. In this case, the carriage 5 stands by at a position for releasing engagement of the lock pawl 665 until the final rotation starts. During the paper feed operation, when the leading end of recording paper is detected by a paper end sensor 142 located between the paper feed roller 7 and the separation rollers 65, the rotation of the paper feed roller 7 is stopped after the recording paper is fed by a predetermined amount from that position, thus completing the paper feed and registration operations of the recording paper.

Thereafter, the carriage 5 is returned to the recovery device 150 side. In this case, the paper width and the presence/absence of the paper are detected by the paper width sensor 1143 arranged on the carriage 5. When the paper feed operation is normally performed, the width of the recording paper, i.e., the size of the recording paper is detected, so that no recording operation is performed outside the recording paper. When no recording paper is detected, a paper feed error is determined, and the apparatus is stopped.

In this embodiment, in order to prevent such a paper feed error, the engagement releasing operation of the lock pawl 665 by the carriage 5 during the paper feed operation is performed at least twice.

After the paper feed operation is completed as described above, the carriage 5 is reciprocally moved in the widthwise direction of the recording paper. Then, the recording operation is performed while feeding the recording paper by one line of the recording head 51 by the paper feed roller 7. In this case, gap precision between the recording head 51 and the recording paper surface is guaranteed by the pressing portion 54 of the carriage 5 which slides on the pinch roller stay 8. More specifically, since the pinch roller 81 is provided to the pinch roller stay 8, when the recording paper enters a gap between the paper feed roller 7 and the pinch roller 81, the pinch roller stay 8 is moved toward the carriage 5, accordingly. Therefore, when the thickness of recording paper changes, since the pinch roller stay 8 is moved accordingly, a uniform gap can always be kept.

The recorded recording paper passes on the heat plate 11 for fixing ink, and is fed to a gap between the exhaust roller 12 and the exhaust pinch rollers 13. When the trailing end of the recording paper is disengaged from the gap between the paper feed roller 7 and the pinch roller 81, the recording paper is conveyed by the exhaust roller 12 and the exhaust pinch rollers 13. After a recording operation for the last line is performed, the recording paper is fed onto the exhaust tray 1010. The recording paper fed onto the exhaust tray 1010 is subjected to a fixing operation or the like by heat produced by the heat radiation plate 79*a* of the power source unit 79.

In this embodiment, when recording paper is thick like an envelope or a post card, when the trailing end of the paper is disengaged from the gap between the paper feed roller 7 and the pinch roller 81, the carriage projecting portion 55 slides on the paper pressing plate 10 which projects toward the carriage due to the thickness of the paper. Therefore, the ejection surface of the recording head 51 can be prevented from directly rubbing the surface of the recording paper.

With the above operation, a recording operation of recording paper is completed. Thereafter, the same operation is repeated.

Figure 4B:
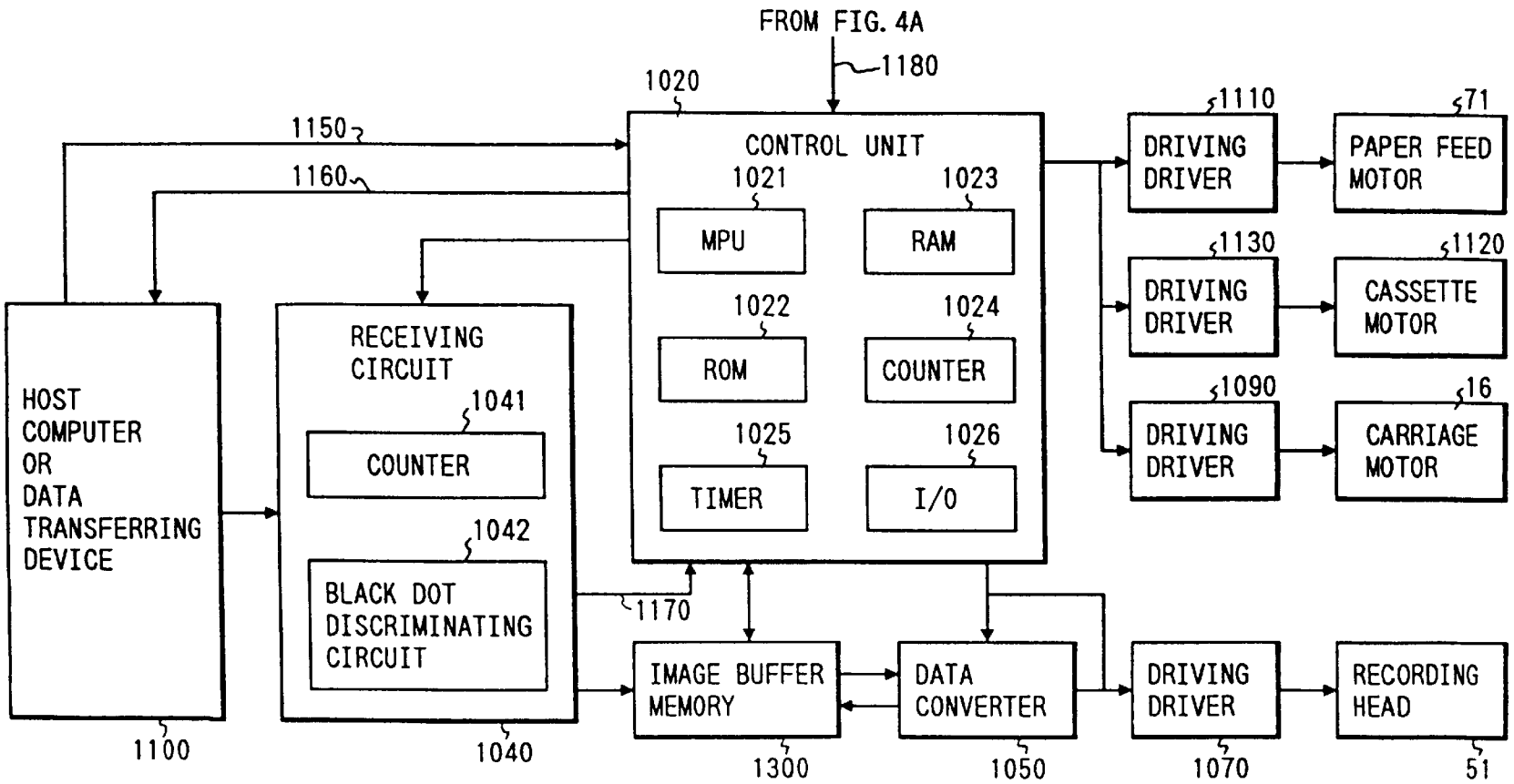

FIG. 4, which is comprised of FIGS. 4A and 4B, is a block diagram showing a schematic arrangement of the recording apparatus (to be referred to as a printer hereinafter) described above.

In FIG. 4, the host computer or data transferring device 1100 outputs image data for each line in the horizontal direction (print direction). Image data in units of lines supplied from the host computer (data transferring device) 1100 to the printer is transferred at a clock rate of a predetermined frequency in accordance with a trigger signal 1160 from a control unit 1020.

The control unit 1020 controls the entire printer. For example, the control unit 1020 comprises an MPU 1021 such as a microprocessor, and a ROM 1022 for storing control programs of the MPU 1021, control sequences shown in flow charts (to be described later), data, and the like. The control unit 1020 also comprises a RAM 1023 including areas which are used as work areas, and store, e.g., a paper width, a count value obtained by calculating a data value according to the paper width, and a total value obtained by calculating the total number of reception lines according to the count value, a counter 1024 for counting the number of paper feed operations and carriage feed pulses, a timer 1025 for measuring a time in response to an instruction from the MPU 1021, and for, when it measures an instructed time, outputting an interrupt signal to the MPU 1021, and an I/O port 1026 for inputting/outputting various data and control signals, and the like.

An image buffer 1300 stores image data supplied from the host computer 1100 corresponding to at least the number of recording elements of the recording head (128 lines in this embodiment). The image data from the host computer (data transferring device) 1100 are sequentially stored in the image buffer memory 1300 under the control of the control unit 1020. A receiving circuit 1040 comprises a counter 1041 in which the number of image data to be received per line can be set. The receiving circuit 1040 outputs a detection signal 1170 to the control unit 1020 upon reception of a data count set by the control unit 1020. The receiving circuit 1040 also comprises a black dot discriminating circuit 1042 which can detect the presence/absence of a black dot.

A data converter 1050 reads out data for lines (e.g., 128 lines) corresponding to the number of recording elements of the recording head 51 every column (128 dots) from the image buffer memory 1300, and outputs the readout data in correspondence with a recording position of the recording head 51.

Note that the recording head 51 used in this embodiment is an ink-jet recording head which scans ink nozzles in the horizontal direction to perform a recording operation. In this head, ink nozzles constituted by 128 ejection orifices and ejection energy generating elements corresponding to the ejection orifices are arrayed in line in the vertical direction.

A driver 1070 drives the recording elements of the recording head 51 on the basis of print data from the data converter 1050.

The carriage motor 16 scans the carriage 5 which mounts the recording head 51 in the horizontal direction. A carriage motor driver 1090 drives the carriage motor 16 in accordance with control data from the control unit 1020. The paper feed motor 71 can feed recording paper by an amount equal to a pitch between adjacent recording elements of the recording head 51, and is driven by a driver 1110. A cassette motor 1120 for a cassette feeder is driven to feed recording paper from a cassette upon an instruction from the host computer (data transferring device) 1100 or an instruction from a key panel 1141 in an information inputting unit 1140 (to be described later). The motor 1120 is driven by a driving driver 1130. In this embodiment, each of the carriage motor 16, the paper feed motor 71, and the cassette motor 1120 comprises a stepping motor.

The information inputting unit 1140 supplies various information to the control unit 1020. The information is output to the control unit 1020 as a detection signal 1180. The information inputting unit 1140 comprises the following components. That is, the key panel 1141 can instruct a paper size, e.g., an A4 size (210 mm×297 mm), a B5 size (181 mm×256 mm), and the like, and a paper end sensor 1142 is used for positioning the leading end of recording paper P during paper feed or detecting its trailing end. The paper width sensor 1143 is mounted on the carriage 5 in this embodiment, and detects a paper width of the fed recording paper to prevent a recording operation at a position outside the recording paper. A unit 1144 for detecting cassette mounting detects whether or not a paper cassette feeder is mounted. A unit 1145 for detecting the presence/absence of cassette paper detects the presence/absence of paper sheets in the cassette. A unit 1146 for detecting the presence/absence of an ink detects the-presence/absence of ink in the ink cartridge for supplying a recording ink to the recording head 51. A unit 1147 for detecting the presence/absence of the ink cartridge detects the presence/absence of the ink cartridge. A unit 1149 for detecting a home position of a pump determines home positions of a cap mechanism (not shown) and a pump mechanism (not shown) unique to the ink-jet recording apparatus. A unit 1410 for detecting a home position of the carriage determines the home position of the carriage 5 which mounts the recording head 51. A unit 1141 for detecting opening/closing of a door detects an opening/closing state of the door.

The host computer (data transferring device) 1100 outputs a command signal 1150 such as a paper size command, recording command, and the like. That is, a paper size can be designated not only by the information inputting unit 1140 but also by the host computer 1100.

Figure 5A:
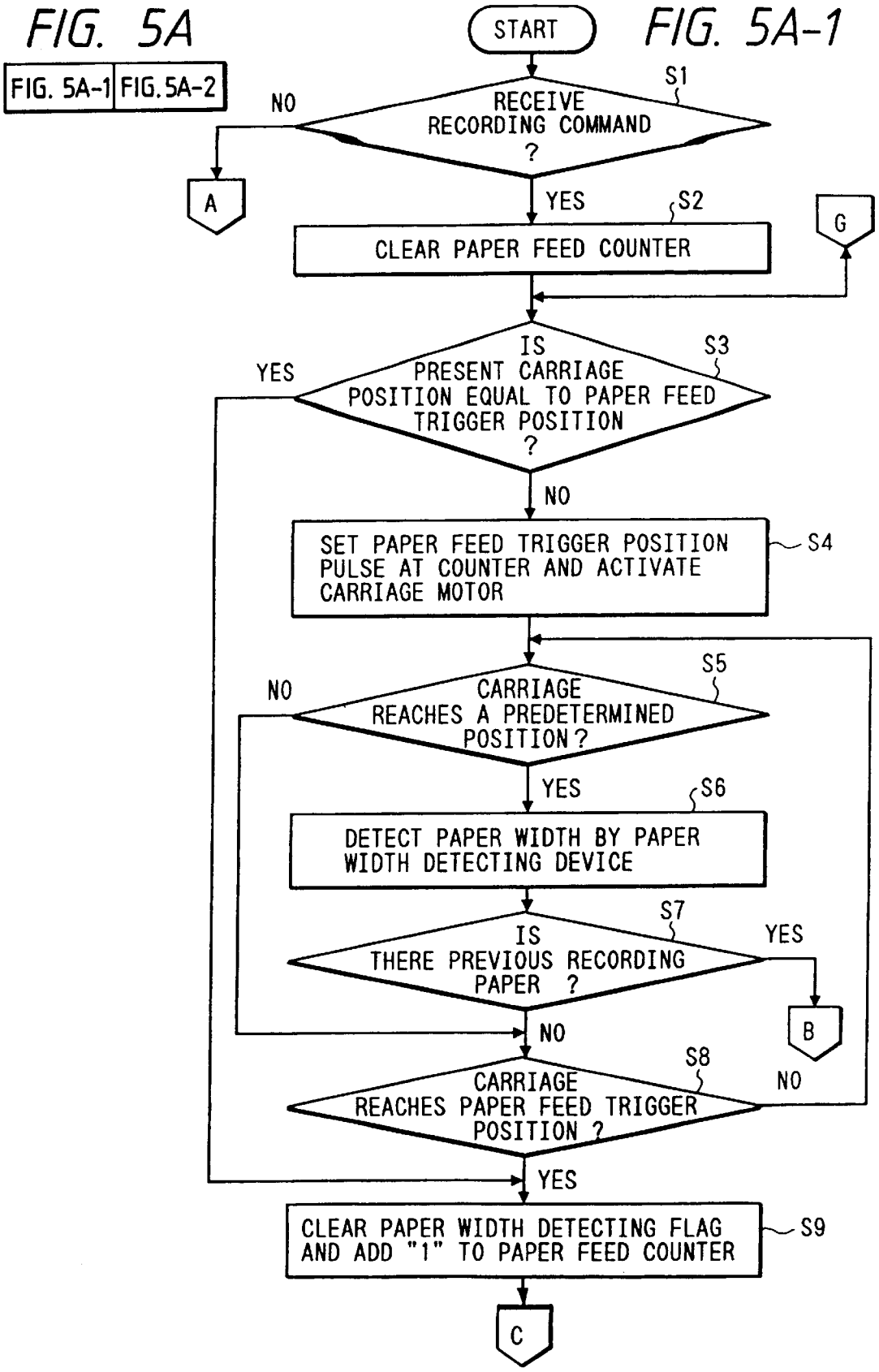
FIG. 5A, which is comprised of FIGS. 5A-1 and 5A-2, and FIG. 5B, which is comprised of FIGS. 5B-1 and 5B-2, are flow charts of paper feed trigger processing by a carriage according to the embodiment of the present invention.
Figures 2, 5A:
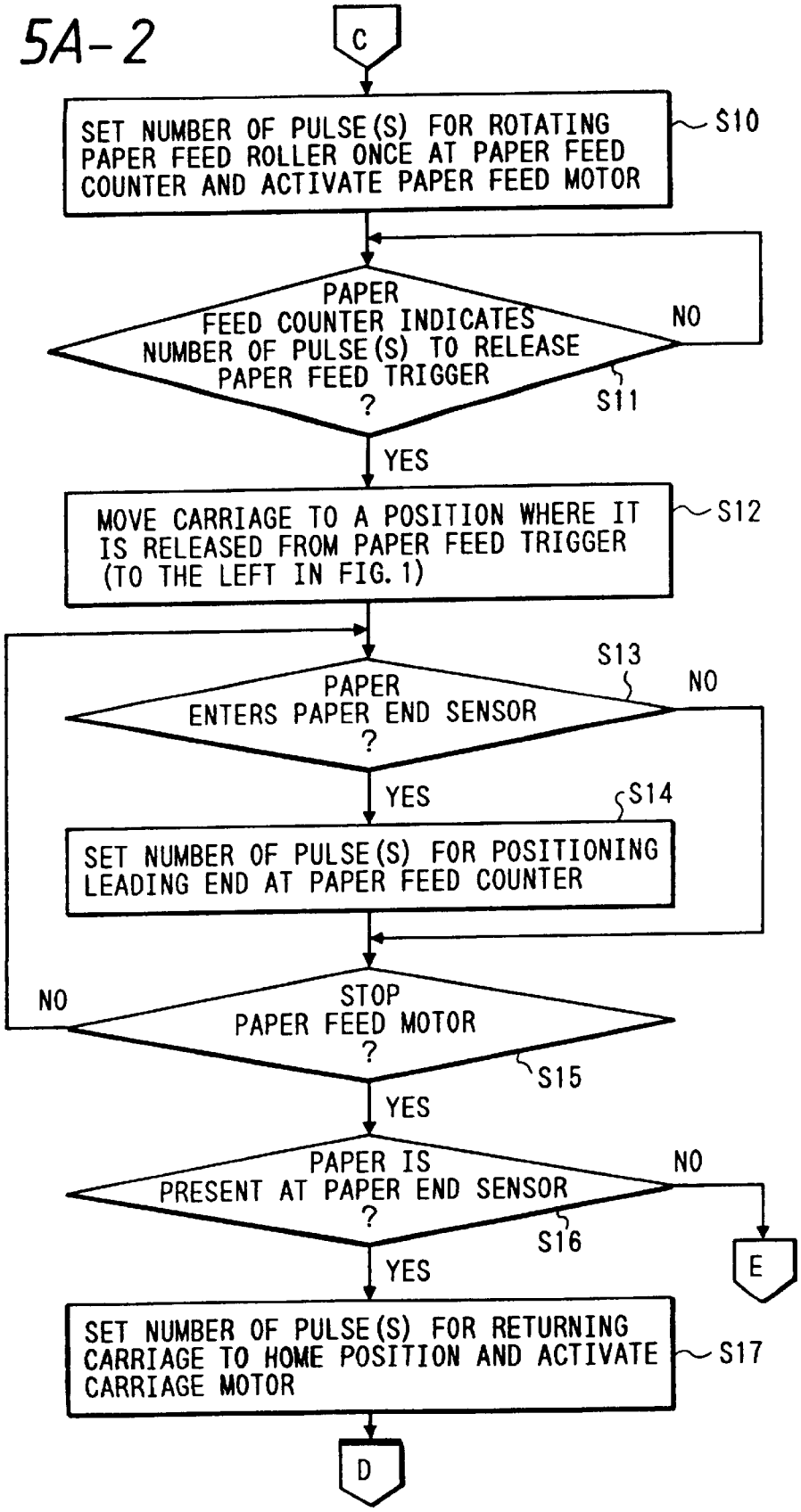
Figures 1, 5B:
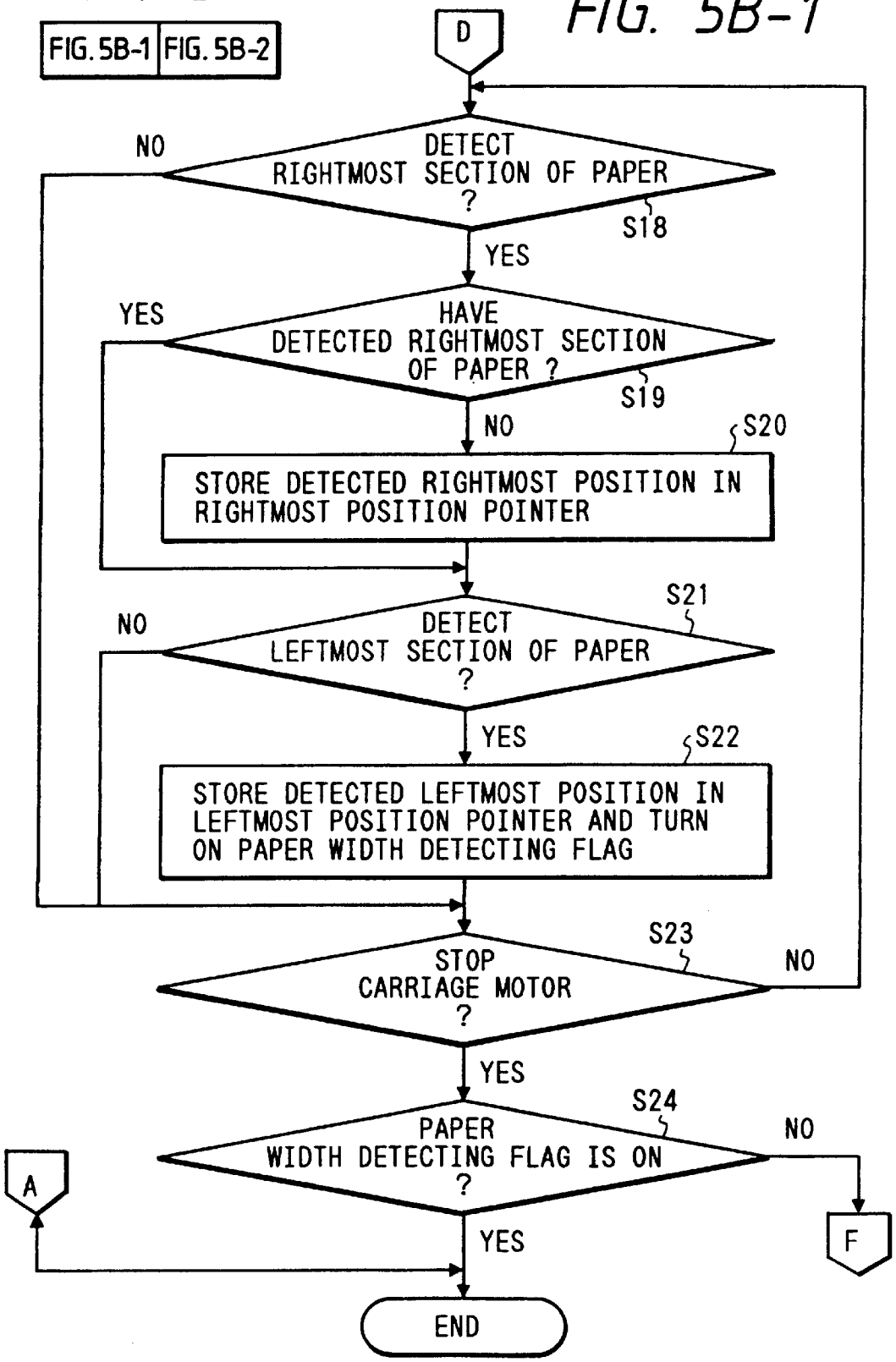
Figure 5B:
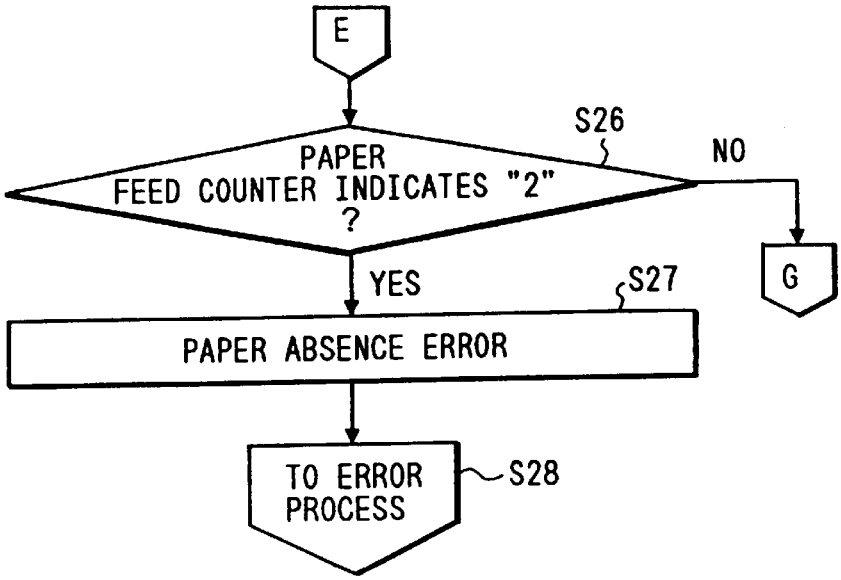
Figure 2:
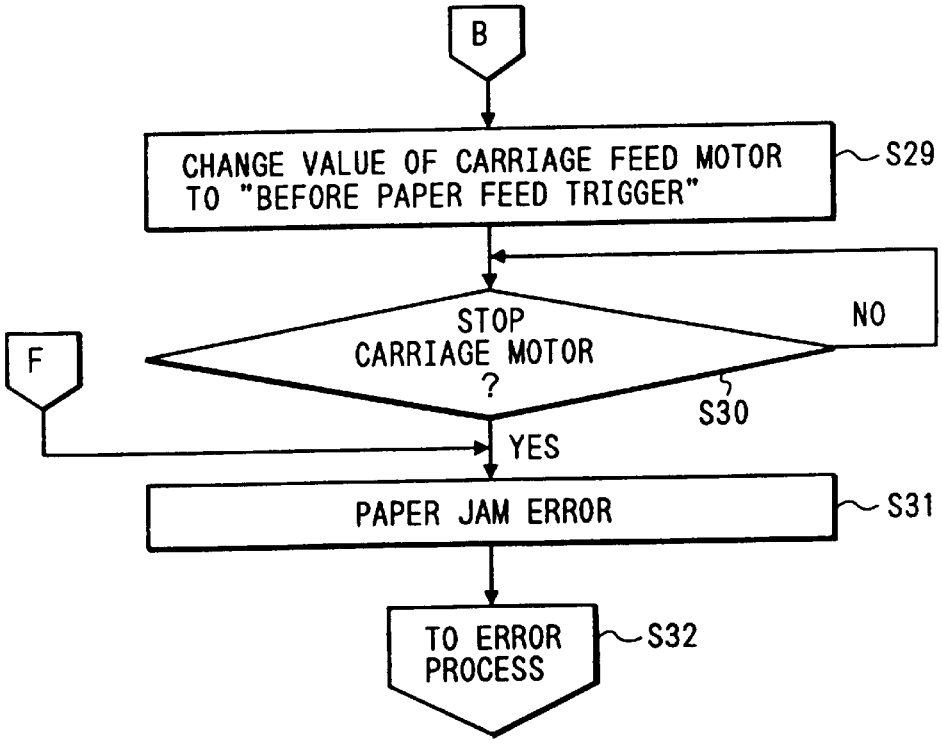

FIG. 5A, which is comprised of FIGS. 5A-1 and 5A-2, and FIG. 5B, which is comprised of FIGS. 5B-1 and 5B-2, are flow charts of processing by the arrangement shown in FIGS. 1 to 4 according to the embodiment of the present invention. The embodiment of the present invention will be described below with reference to FIGS. 5A and 5B.

It is checked in step S1 if a recording command from the host computer (data transferring device) 1100 is supplied to the control unit 1020 as the signal 1150. If NO in step S1, this processing is ended, and control enters the next processing. However, if YES in step S1, the flow advances to step S2, and a paper feed counter (for counting the number of paper feed trigger operations) allocated in the counter 1024 in the control unit 1020 is cleared. It is then checked in step S3 if the present position of the carriage 5 is equal to the paper feed trigger position. If YES in step S3, the flow advances to step S9; otherwise, the flow advances to step S4. In step S4, a paper feed trigger position pulse is set in a carriage counter allocated in the counter 1024 to start the carriage motor 16. It is checked in step S5 if the carriage 5 reaches a predetermined position where whether or not the recording paper P is precisely fed can be detected. If YES in step S5, the flow advances to step S6, and a paper width is detected by the paper width sensor 1143 of the information inputting unit 1140. However, if NO in step S5, the flow advances to step S8. In step S7, the presence/absence of previous recording paper is detected by the paper width detection processing in step S6. If YES in step S7, i.e., if the previous recording paper remains, the flow advances to step S29. If NO in step S7, the flow advances to step S8 to check if the carriage 5 reaches the paper feed trigger position. If NO in step S8, the operations in steps S5 to S8 are repeated.

If YES in step S8, "1" is added to the paper feed counter allocated in the counter 1024, and a paper width detecting flag in the RAM 1023 of the control unit 1020 is cleared in step S9. In step S10, the number of pulses for rotating the separation rollers 65 once is set in the paper feed counter allocated in the counter 1024 to start the paper feed motor. In step S11, it is waited until the paper feed counter indicates the number of pulses for canceling a paper feed trigger upon movement of the carriage 5, i.e., the number of pulses for moving the carriage 5 so that the lock pawl 665 can be moved to a position where it can hook the lock ring 664 by its own elastic force. If YES in step S11, the carriage 5 is moved to a predetermined position so that the lock pawl can be returned to the hook position by its own elastic force in step S12.

It is checked in step S13 if the recording paper reaches the position of the paper end sensor 1142 of the information inputting unit 1140. If YES in step S13 (that is, when the recording paper has reached the position of the sensor 1142), the number of pulses capable of positioning the leading end of the recording paper is set in the paper feed counter 1024. However, if NO in step S13 (that is, when the recording paper does not yet reach the position of the sensor 1142), the flow advances to step S15 to check if the paper feed motor 71 is stopped. If NO in step S15, the processing in steps S13 to S15 is repeated. If YES in step S15, the flow advances to step S16 to check again if the recording paper is present at the position of the paper end sensor 1142. If YES in step S16, the flow advances to step S17; otherwise, the flow advances to step S25.

In step S17, the number of pulses for returning the carriage 5 to the home position is set in the carriage counter 1024, and the carriage motor 16 is started. It is checked in step S18 if the paper width sensor 1143 detects the rightmost section of the recording paper. If NO in step S18, the flow advances to step S23; otherwise, the flow advances to step S19. It is checked in step S19 if the rightmost section of the recording paper has been detected, i.e., if the rightmost position has already been registered in the previous recording operation. If YES in step S19, the flow advances to step S21; otherwise, the detected rightmost position is stored in a rightmost position pointer allocated in the RAM 1023 in the control unit 1020 in step S20. It is checked in step S21 if the leftmost position of the recording paper is detected. If NO in step S21, the flow advances to step S23; otherwise, the flow advances to step S22, and the detected leftmost position is stored in a leftmost position pointer similarly allocated as the rightmost position pointer to turn on the paper width detecting flag. It is checked in step S23 if the carriage motor 16 is stopped. If YES in step S23, the flow advances to step S24; otherwise, the operations in steps S18 to S23 are repeated.

It is checked in step S24 if the paper width detecting flag is ON. If NO in step S24, the flow advances to step S31; otherwise, this processing is ended, and control enters the next processing.

When the flow advances from step S16 to step S26, it is checked in step S26 if the paper feed counter is "2". If YES in step S26, a paper absence error is determined in step S27, and the control enters error processing. If NO in step S26, the flow returns to step S3, and the operations in steps S3 to S26 are repeated. Thus, when it is detected that the recording paper is fed, the second paper feed trigger operation, i.e., an operation for releasing the lock pawl 665 upon operation of the carriage 5 is performed to eliminate a release error of the lock pawl 665, thus allowing a reliable paper feed operation.

When the flow advances from step S7 to step S29, the value of the carriage counter 1024 is changed to indicate a position before the paper feed trigger position. After it is determined in step S30 that the carriage motor 16 is stopped, a jam error is determined in step S31, and the control enters error processing in step S32.

In this embodiment, the paper feed trigger operation is performed twice. However, this operation may be repeated more than twice according to paper quality of recording paper mainly used.

In this embodiment, the paper feed operation of the ink-jet recording apparatus has been described. However, the present invention is not limited to this but may be effectively applied to any other recording apparatuses as long as the recording apparatuses have a carriage mounting a recording head and a paper feed mechanism. That is, a recording method is not limited to an ink-jet recording method. For example, the present invention may be applied to a thermal recording method, a thermal transfer method, a wire-dot recording method, a daisy wheel recording method, and the like.

As can be apparent from the above description, according to this embodiment, while no paper is fed, a paper feed trigger operation for releasing a paper feed trigger means such as a lock pawl in a spring clutch upon movement of a carriage can be performed a plurality of times.

As a result, a paper feed trigger error of, e.g., releasing the lock pawl can be prevented, and a stable paper feed operation can be performed for thick paper such as envelopes, post cards, and the like.

As described above, according to the present invention, there can be provided a recording apparatus which can reliably feed a recording medium.

What is claimed is:

1. A recording apparatus for recording, using a recording head, onto a sheet member conveyed to a recording area where recording is performed by the recording head, said apparatus comprising:

sheet member holding means for holding a stack of sheet members to be conveyed to the recording area;

a separating supply roller supplying a sheet member in the stack of sheet members held by said sheet member holding means from said sheet member holding means to the recording area, said separating supply roller having a peripheral surface contactable with the sheet member from the stack and supplying the sheet member upon a predetermined rotation amount of the peripheral surface;

a pinch roller provided between said separating supply roller and the recording area and in a sheet member conveyance route immediately after said separating supply roller with respect to a conveyance direction of the sheet member, said pinch roller pinching and conveying the sheet member, supplied by said separating supply roller, in association with an opposed member;

detecting means located between said separating supply roller and said pinch roller for detecting the sheet member conveyed from said separating supply roller to said pinch roller;

a carriage mounting the recording head thereon and reciprocally moving the recording head in an area including the recording area;

switching means for issuing a command to enable a drive transmitting route for the supplying of the sheet member to the recording area by said separating supply roller in accordance with the movement of said carriage to outside the recording area; and control means for rotating said separating supply roller by a predetermined amount again in a case in which the sheet member conveyed by said separating supply roller to the recording area is not detected by said detecting means after said switching means has issued a command to enable the drive transmitting route.

2. A recording apparatus according to claim 1, wherein the recording head is an ink jet recording head performing the recording operation by discharging an ink drop on the sheet member.

* * * * *

UNITED STATES PATENT AND TRADEMARK OFFICE

CERTIFICATE OF CORRECTION

PATENT NO. : 6,169,557 B1
DATED : January 2, 2001
INVENTOR(S) : Suzuki et al.

It is certified that error appears in the above-identified patent and that said Letters Patent is hereby corrected as shown below:

Column 1,
Line 35, "(Japanese" should read -- Japanese --; and
Line 36, "1988)." should read -- 1988. --.

Column 3,
Line 31,"angle a" should read -- angle *a* --.

Column 9,
Line 2, "1141" should read -- 1411 --.

Signed and Sealed this

Ninth Day of April, 2002

*Attest:*

*Attesting Officer*

JAMES E. ROGAN
*Director of the United States Patent and Trademark Office*